United States Patent [19]

Avery

[11] Patent Number: 4,745,966

[45] Date of Patent: May 24, 1988

[54] HEAT EXCHANGERS AND ELECTRICAL APPARATUS HAVING HEAT EXCHANGERS

[75] Inventor: Randall N. Avery, Bogart, Ga.

[73] Assignee: Westinghouse Electric Corp., Pittsburgh, Pa.

[21] Appl. No.: 888,656

[22] Filed: Jul. 22, 1986

[51] Int. Cl.[4] ..... H01F 27/12

[52] U.S. Cl. ..... 165/104.33; 29/157.3 R; 165/906; 336/58

[58] Field of Search ..... 165/104.33; 336/58; 29/157.3 R; 165/906

[56] References Cited

U.S. PATENT DOCUMENTS

| | | | |
|---|---|---|---|
| 1,261,637 | 4/1918 | Sonneborn . | |
| 1,288,330 | 12/1918 | White, Jr. | 336/58 |
| 1,348,328 | 3/1920 | Sonneborn . | |
| 1,420,016 | 6/1922 | Bingay . | |
| 1,429,927 | 9/1922 | Carter . | |
| 1,444,480 | 2/1923 | Patch . | |
| 1,471,888 | 10/1923 | Elder | 165/104.33 |
| 1,472,863 | 11/1923 | Bingay . | |
| 1,473,595 | 11/1923 | Bingay . | |
| 1,477,792 | 12/1923 | Wagner . | |
| 1,550,154 | 8/1925 | Faccioli . | |
| 1,571,300 | 2/1926 | Reed . | |
| 1,583,383 | 5/1926 | Bingay . | |
| 1,631,711 | 6/1927 | Treanor . | |
| 3,921,112 | 11/1975 | Broverman | 336/58 |
| 4,413,674 | 11/1983 | Avery et al. . | |

FOREIGN PATENT DOCUMENTS

| | | | |
|---|---|---|---|
| 63812 | 5/1980 | Japan | 336/58 |
| 105306 | 8/1980 | Japan | 336/58 |
| 151313 | 11/1980 | Japan | 336/58 |
| 158611 | 12/1980 | Japan | 336/58 |

*Primary Examiner*—Albert W. Davis, Jr.
*Attorney, Agent, or Firm*—D. R. Lackey

[57] ABSTRACT

A heat exchanger panel suitable for cooling fluid filled electrical apparatus, such as electrical distribution and power transformers, and method of constructing same, which withstands substantially higher pressures without adding significantly to the weight of the heat exchanger. The metallic sheet which is used to construct the heat exchanger panel includes edges which define a substantially rectangular configuration, with predetermined opposite edges therof being folded to increase the edge thickness of the sheet prior to forming the fins. The fins are formed via bend lines which extend from folded edge to folded edge. This provides at least twice the material thickness where the heat exchanger panel is welded to the tank of the associated apparatus, and at least four times the material thickness where the folded fin is welded to form the fin cavity.

29 Claims, 9 Drawing Sheets

FIG. 6
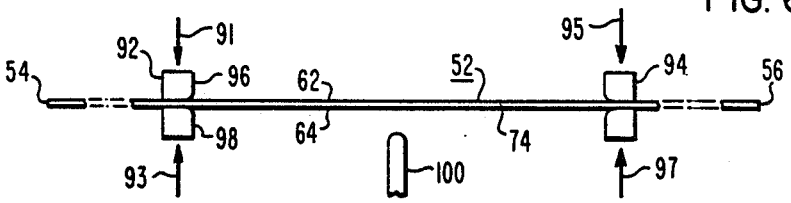
FIG. 7
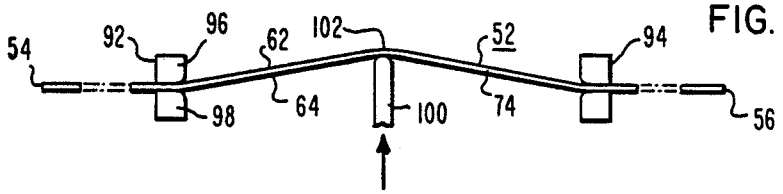
FIG. 8
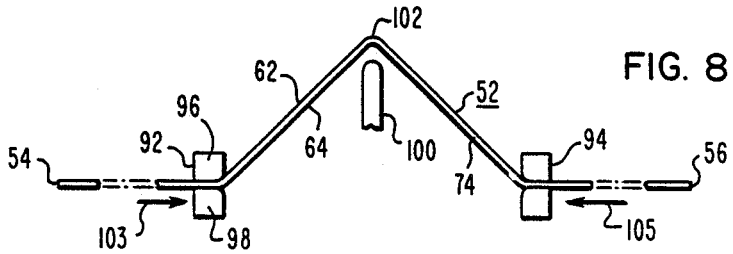
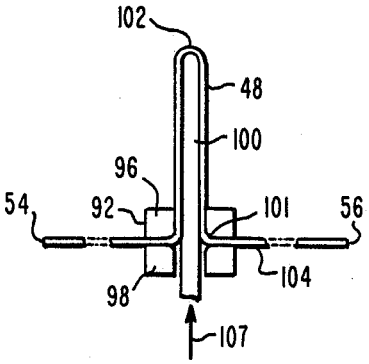
FIG. 9
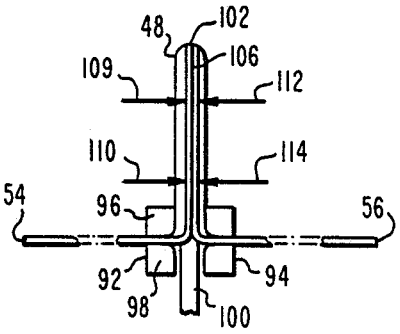
FIG. 10

HEAT EXCHANGERS AND ELECTRICAL APPARATUS HAVING HEAT EXCHANGERS

BACKGROUND OF THE INVENTION

1. Field of the Invention

The invention relates in general to heat exchangers, to electrical apparatus having heat exchangers, and methods of constructing same, and more specifically to heat exchangers suitable for electrical inductive apparatus, such as electrical distribution and power transformers.

2. Description of the Prior Art

Electrical apparatus which includes heat generating means disposed in a tank with a fluid cooling dielectric, liquid, vapor or gas, including liquids such as mineral oil, vaporizable liquids such as perchloroethylene, and gasses such as SF6 gas, must exchange the heat built up in the tank with the atmosphere. When the tank itself does not provide the requisite heat exchange surface, the fluid cooling dielectric is circulated through heat exchangers which are connected to the tank. The flow may be natural thermal siphon, or forced via suitable pumping means, as desired.

The hermetically sealed tank of electrical apparatus, such as electrical distribution and power transformers, and heat exchanger apparatus associated with the tank, are subjected to relatively high pressures during normal thermal cycling. In addition to withstanding normal pressures, the tank and associated heat exchanger apparatus must be able to withstand extremely high pressures for short periods of time without rupturing the tank or heat exchanger apparatus, which pressures may be created by abnormal conditions, such as internal faults.

In the prior art, the tanks and associated heat exchanger apparatus are constructed of steel having the requisite thickness dimensions to accommodate the pressure tests prescribed by the manufacturer and industry standards.

SUMMARY OF THE INVENTION

Briefly, the present invention relates to new and improved heat exchangers, and to electrical apparatus having heat exchangers, such as electrical distribution and power transformers, and methods of constructing same, which heat exchangers and apparatus will support higher pressures with thinner gauge material in the heat exchanger. Heat exchanger panels are constructed from a metallic sheet having edges which define a generally rectangular configuration. Predetermined opposite edges of the metallic sheet are folded or edge rolled such that each predetermined edge is rolled over on itself at least once. Heat exchanger fins are then formed in the metallic sheet via bend lines which extend between the folded edges. This provides a heat exchanger panel in which the panel edges to be joined to a tank, or other suitable structure, have at least twice the thickness of the base material, strengthening the material of the heat exchanger at the weakest point, i.e., where the heat exchanger panels are welded to the tank or associated structure. The folded edges distribute the stresses created at the tank-heat exchanger interface over more steel, substantially increasing the pressures the associated tank and heat exchanger panel will withstand. The tank and heat exchanger panel will withstand about the same pressures as the combination would withstand had the heat exchanger panel been constructed of material having a thicker dimension, thus acheiving higher withstand pressures without significantly adding to the weight of the heat exchanger.

The invention also substantially increases the mechanical strength of the fins themselves by providing at least four times the material thickness in the areas of the heat exchanger fins which are welded after the fins are formed by the bending steps.

In addition to substantially increasing the strength of the combination which includes a tank and its associated heat exchanger panel, or panels, the invention allows higher welding speeds, e.g., 20 to 25% faster, without increasing the risk of burn-through. It eliminates the need for edge trimming, and the problem of scrap handling created by the edge trimming process, as the edge folding process automatically creates smooth, clean parallel edges. The rounded edges also are easier for manufacturing personnel to handle, and the rounded edges improve paint adhesion and corrosion withstand capability.

BRIEF DESCRIPTION OF THE DRAWINGS

The invention may be better understood, and further advantages and uses thereof more readily apparent when considered in view of the following detailed description of exemplary embodiments, taken with the accompanying drawings, in which:

FIG. 6 illustrates a step in the formation of a heat exchanger fin, in which the material shown in FIGS. 3, 4 or 5 is clamped at predetermined spaced locations;

FIG. 7 illustrates a step which follows the step of FIG. 6, in which the material is creased at the desired bend line;

FIG. 8 illustrates a step which follows the creasing step of FIG. 7, in which the clamped ends are moved towards one another to fold the material about a spacing tool;

FIG. 9 illustrates a step which follows the folding step of FIG. 8, illustrating a step of stretching the corners of the folded material;

FIG. 10 illustrates a step of crimping the upper and lower edges of the folded material, preparatory to welding the crimped edges to complete the fin cavity;

DESCRIPTION OF PREFERRED EMBODIMENTS

Figure 1:
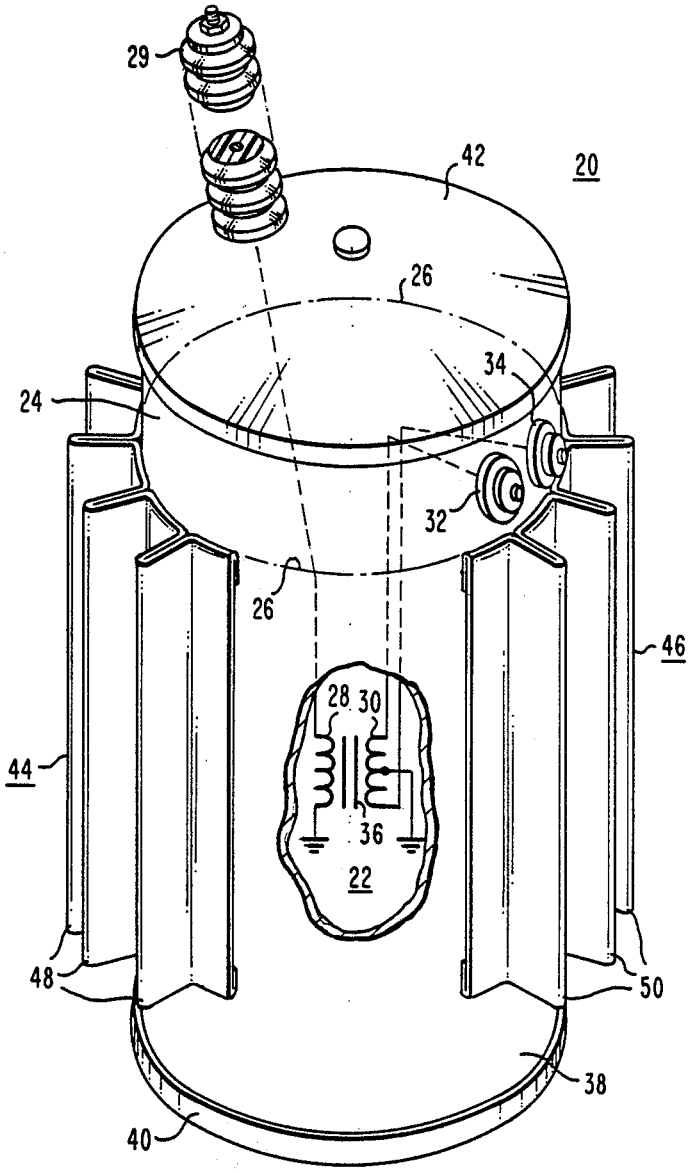
FIG. 1 is a perspective view of an electrical transformer which may be constructed according to the teachings of the invention.

The invention relates in general to heat exchangers for cooling electrical apparatus having heat producing means disposed in a sealed tank, which apparatus is surrounded by a fluid insulating dielectric and cooling means. The fluid may be liquid which remains in the liquid form throughout the cooling process, such as mineral oil; it may be a liquid which may have both liquid and vapor phases in the normal cooling temperature cycle of the apparatus, such as perchloroethylene; or it may be a gas, such as sulphur hexaflouride (SF6). For purposes of example, the invention will be described relative to electrical distribution and power transformers, such as the electrical distribution transformer 20 shown in FIG. 1.

More specifically, transformer 20 includes a core-coil assembly 22 disposed in a hermetically sealed tank 24. Core-coil assembly 22 is immersed in an electrical insulating dielectric and cooling fluid, such as mineral oil, which has a level indicated at 26. Core-coil assembly 22 includes a primary winding 28 connected to a high voltage bushing 29, and a secondary winding 30 connected to low voltage bushings 32 and 34, with both the primary and secondary windings being disposed in inductive relation with a magnetic core 36. Tank 24 includes a side wall portion 38, which is cylindrical in this example, a bottom portion 40, and a cover 42. Heat exchanger panels 44 and 46, also called "coolers", are attached to the side wall portion 38, such as by welding, with heat exchanger panels 44 and 46 each having a plurality of fins 48 and 50, respectively. The cavities defined by fins 48 and 50 are in fluid flow communication with the insulating and cooling fluid 26 disposed within tank 24, to greatly increase the surface area of the interface between the cooling fluid 26 and the ambient air. As will be hereinafter described, the fluid flow communication may be provided by openings in the side wall portion 38 which are aligned with the fin defined cavities; or, the tank wall 38 may have a large opening, only slightly smaller than the heat exchanger, such that the heat exchanger functions as a portion of the tank wall 38.

Figure 2:
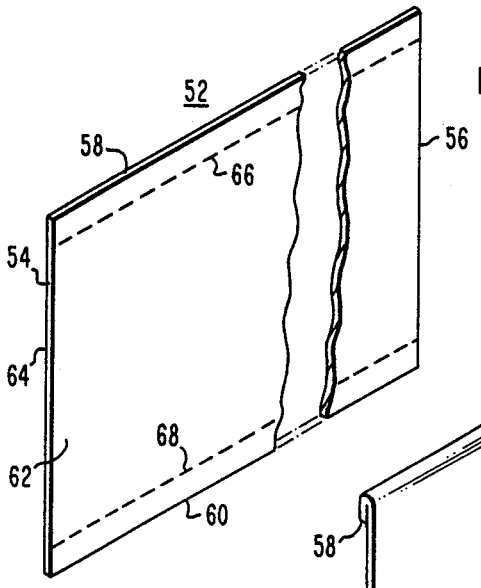
FIG. 2 is a perspective view of the starting material for constructing a heat exchanger panel or "cooler" according to the teachings of the invention.

Heat exchanger panels 44 and 46 are constructed according to the teachings of the invention to provide increased mechanical strength and pressure withstand capability for any selected thickness of steel sheet material used to construct the heat exchanger panels. FIG. 2 is a perspective view of a steel sheet 52 which may be used as the starting material for constructing a heat exchanger panel according to the teachings of the invention. Sheet 52, which may be a low carbon steel, such as 1010 or 1020, for example, has first and second ends 54 and 56, respectively, first and second lateral edges 58 and 60, respectively, which extend between the ends, and first and second major flat surfaces 62 and 64, respectively. The thickness dimension of sheet 52 may be less than used in the prior art for a specific withstand pressure. For example, the prior art has used thicknesses of 1.0 mm, 1.2 mm and 1.5 mm. The thickness used increases as the height and width of the heat exchanger panel is increased. With the present invention, 1.0 mm thick material may be used to cover a wider range of coolers required for distribution transformers, having sufficient strength to withstand a 50 psi test standard, and 1.2 mm material may be used in large ratings which normally would require 1.5 mm material.

Figure 3:
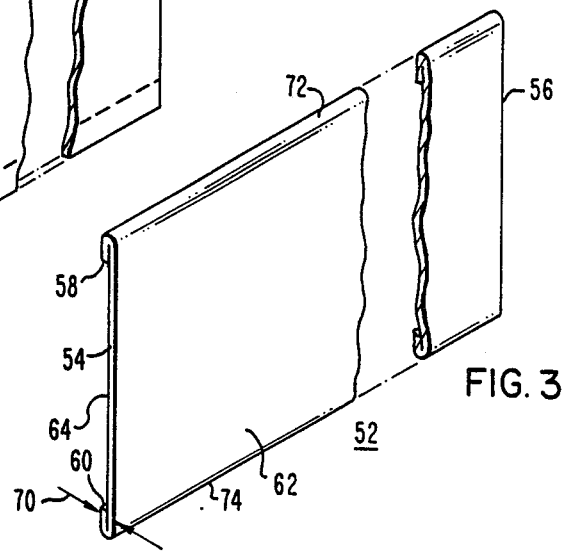
FIG. 3 is a perspective view of the starting material shown in FIG. 2, after predetermined opposite edges have been rolled over or folded according to a preferred embodiment of the invention.

FIG. 3 is a perspective view of sheet 52 after a step of the invention in which the lateral edges 58 and 60 have been roll formed or folded over along predetermined bend lines 66 and 68 shown in FIG. 2, to provide bends 72 and 74 which also function as new lateral edges, doubling the thickness dimension 70 of the material adjacent to newly formed lateral edges 72 and 74. The newly formed edges 72 and 74 are also straight and smoothly rounded, eliminating any trimming which might otherwise be required to provide a straight edge. The rounded edges are also easier for manufacturing personnel to handle.

Figure 4:
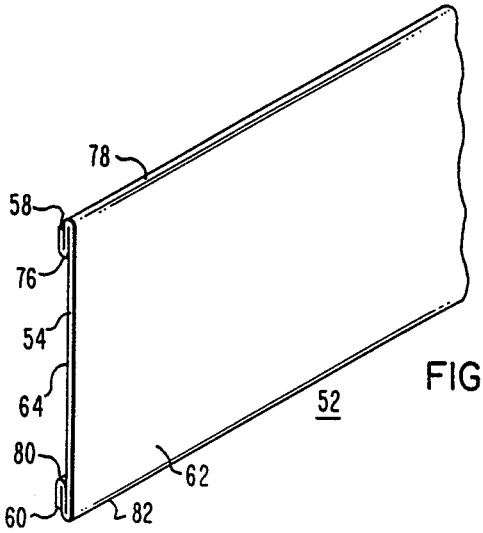
FIG. 4 is a perspective view of the starting material shown in FIG. 2, after predetermined opposite edges have been rolled or folded according to another embodiment of the invention.
Figure 5:
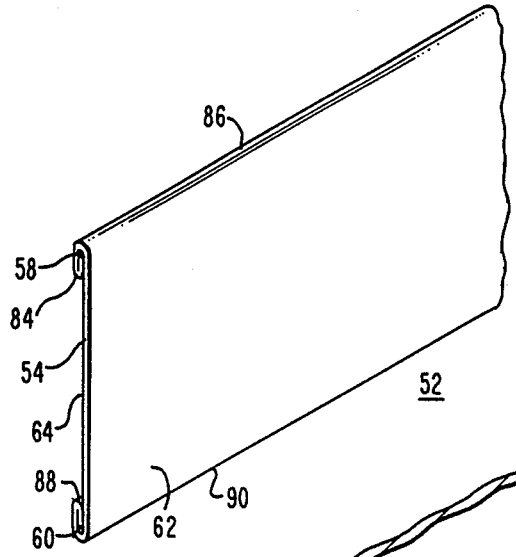
FIG. 5 is a perspective view of the starting material shown in FIG. 2, after predetermined opposite edges have been rolled or folded according to still another embodiment of the invention.

FIGS. 4 and 5 are perspective views of sheet 52 after alternative edge forming steps which may be used to increase the thickness of the material adjacent to the lateral edges of sheet 52. Instead of providing a single fold adjacent to the lateral edges, as shown in FIG. 3, the material may be subjected to two closely spaced bends to triple the thickness dimension adjacent to the newly formed lateral edges. For example, in FIG. 4 the sheet material 52 is bent in different directions at two closely spaced bend lines which provide bends 76 and 78 adjacent to edge 58, and at two closely spaced bend lines which provide bends 80 and 82 adjacent to edge 60. Bends 78 and 82 function as new lateral edges. In FIG. 5, sheet material 52 is bent in the same direction at two closely spaced bend lines which provide bends 84 and 86 adjacent to edge 58, and at two closely spaced bend lines which provide bends 88 and 90 adjacent to edge 60. Bends 86 and 90 function as new lateral edges. In the embodiments of FIGS. 4 and 5, the materal adjacent to edges 58 and 60 may require heating prior to the bending operation, or a deep draw steel may be used, to create the tight bends without cracking the material.

FIGS. 6 through 10 illustrate method steps which may be used to form each of the fins of the heat exchanger panels 44 and 46, respectively, such as fin 48. For purposes of example, it will be assumed that the edges of sheet 52 have been roll formed as shown in FIG. 3, with a single bend adjacent to each of the lateral edges. The step shown in FIG. 6 clamps the sheet material 52, after the edge rolling step, at two spaced locations, with the spacing being in a direction between the ends 54 and 56 of the sheet. The clamping means is indicated generally at 92 and 94, and the clamping forces are indicated by arrows 91, 93, 95 and 97. Thus, the clamping bars of the clamping means, such as clamping bars 96 and 98 of clamping means 92, extend from folded edge to folded edge, i.e., between newly formed lateral edges 72 and 74.

FIG. 7 introduces the step of creasing sheet 52 where the nose 102 of fin 48 is to be formed, such as with a tool or blade 100 which may also function as a spacing tool for establishing the internal width dimension of the fin cavity.

FIG. 8 illustrates the step of folding sheet material 52 by moving the clamping means 92 and 94 towards the spacing tool 100, to form the internal gap or width dimension of fin 48. The moving forces are illustrated with arrows 103 and 105.

FIG. 9 illustrates an optional step of stretching the corners of fin 48, to radius the transition 101 from fin 48 to the panel wall material 104. The stretching force is indicated by arrow 107.

FIG. 10 illustrates the step of crimping the upper and lower edges 106 and 108, above and below the upper and lower edges of the spacing tool 100, such that the crimped edges are close together and ready for a joining operation, such as welding. The crimping forces are indicated in FIG. 10 by arrows 109, 110, 112 and 114. The lower crimped edge 108 is best shown in FIG. 11.

The steps set forth in FIGS. 6 through 10 are then repeated on sheet 52 until the desired number of fins 48 are formed on heat exchanger panel 44. The upper and lower crimped edges 106 and 108 of all of the fins 48 are then welded to complete the fins and provide fluid tight cavities through which the fluid 26 may be circulated after the heat exchanger panel has been joined to the sidewall 38 of tank 24.

Figure 11:
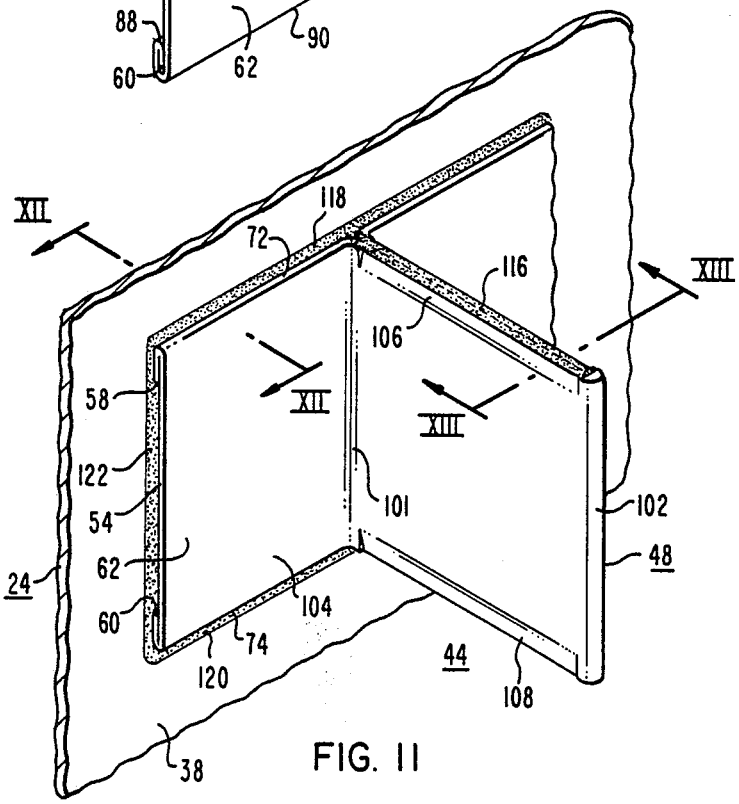
FIG. 11 is a fragmentary perspective view of a heat exchanger panel formed according to the method steps set forth in FIGS. 2 through 10, and welded to the tank of electrical apparatus, such as the distribution transformer shown in FIG. 1, or a power transformer.

FIG. 11 is a fragmentary perspective view of heat exchanger panel 44 connected to side wall 38 of tank 24. FIG. 11 clearly illustrates a welding bead 116 joining the four thicknesses of the crimped upper edge 106 of fin 48, welding beads 118 and 120 joining the double-thick upper and lower edges 72 and 74 of sheet 52 (panel wall 104) to the side wall 38, and a welding bead 122 joining the first end 54 of sheet 52 to side wall 38.

Figure 12:
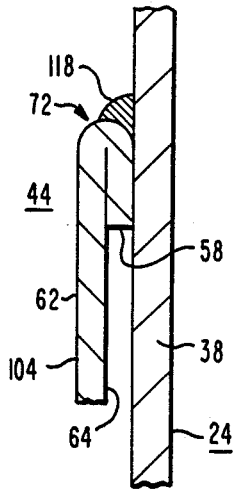
FIG. 12 is a sectional view of the weld area between the heat exchanger panel and tank shown in FIG. 11, taken between and in the direction of arrows XII—XII in FIG. 11, using the edge fold shown in FIG. 3.

FIG. 12 is a sectional view of the upper roll formed edge 72 of heat exchanger panel 44, and the welding bead 118 which joins the panel wall 104 to the side wall 38 of tank 24. FIG. 12 is a view of edge 72 taken between and in the direction of arrows XII—XII in FIG. 11.

Figure 13:
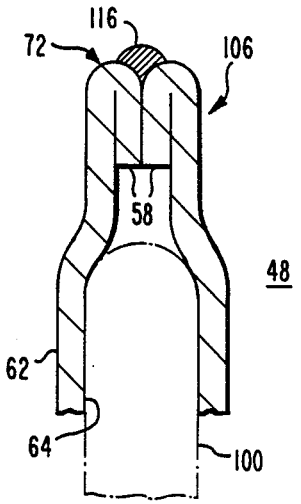
FIG. 13 is a sectional view of the weld area which joins the upper and lower edges of the fin shown in FIG. 11, taken between and in the direction of arrows XIII—XIII in FIG. 11, using the edge fold shown in FIG. 3.

FIG. 13 is a sectional view of the upper crimped edge 106 of fin 48, taken between and in the direction of arrows XIII—XIII in FIG. 11. FIG. 13 illustrates the welding bead 116 which joins the adjacent crimped rolled edges 72 of the folded sheet 52 to seal the crimped upper edge 106 of fin 48.

Figure 14:
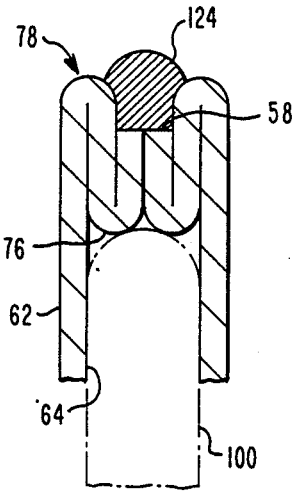
FIG. 14 is a sectional view similar to that of FIG. 13, except using the edge fold shown in FIG. 4.
Figure 15:
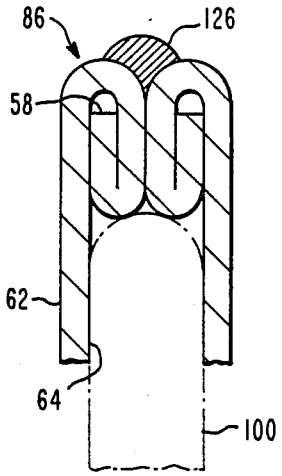
FIG. 15 is a sectional view similar to that of FIG. 13, except using the edge fold shown in FIG. 5.

FIGS. 14 and 15 are sectional views through fin 48 when heat exchanger panel 44 is constructed with sheet 52 after the edges have been rolled according to the embodiments of the invention set forth in FIGS. 4 and 5, respectively. Rolled edges 78 are joined with a welding bead 124 in the FIG. 14 embodiment, and rolled edges 86 are joined with a welding bead 126 in the FIG. 15 embodiment. Of the two embodiments shown in FIGS. 14 and 15, the embodiment of FIG. 14 is preferred because the welding bead 124 more effectively ties the edges together, as is readily apparent from the Figures.

In addition to providing six thicknesses of the sheet material 52 at the upper and lower edges of the fin 48, which increases the mechanical strength of the heat exchanger panel 44, the embodiments of FIGS. 14 and 15 provide the added advantage of being able to eliminate the crimping step set forth in FIG. 10. The exterior crimping bars, indicated functionally in FIG. 10 with arrows 109, 110, 112 and 114, and the spacing tool or blade 100 are moved or replaced by other bars and tools with each change in strip material width, i.e., the dimension between the edges 58 and 60 of sheet 52. By using the embodiments of FIGS. 4 or 5, the material itself, with the double edge folds, will close on itself and leave a sufficiently wide coolant gap inside the fin without the need for crimping bars. The spacing tool or blade 100 will still be required, but it is the easiest tool to change.

If sheet material 52 is 1 mm thick, for example, the double fold on each edge to be joined results in a gap of 4 mm without the crimping step, which gap is sufficient for most heat exchanger panels for distribution transformers. If more coolant flow and higher mechanical strength is required, the simple use of 1.2 mm thick material will increase the coolant gap in the fin and the mechanical strength, still without the use of crimping tools.

Coolers were constructed with 1 mm thick material with and without rolled edges. The coolers with the rolled edges were constructed with the single fold of the FIG. 3 embodiment. The coolers without the rolled edge failed at 35 psi, rupturing with tear lines which start at a crimp weld, e.g., weld 116, just outboard from the tank-to-cooler weld, e.g., weld 118, with the tear extending down both sides of the associated fin. These ruptures occurred prior to any appreciable distortion of the cooler or heat exchanger panel. The coolers constructed with the rolled edge material passed the standard 50 psi test without any distortion or tearing, and were tested up to 62 psi, at which point the coolers were badly distorted and started to tear.

Figure 16:
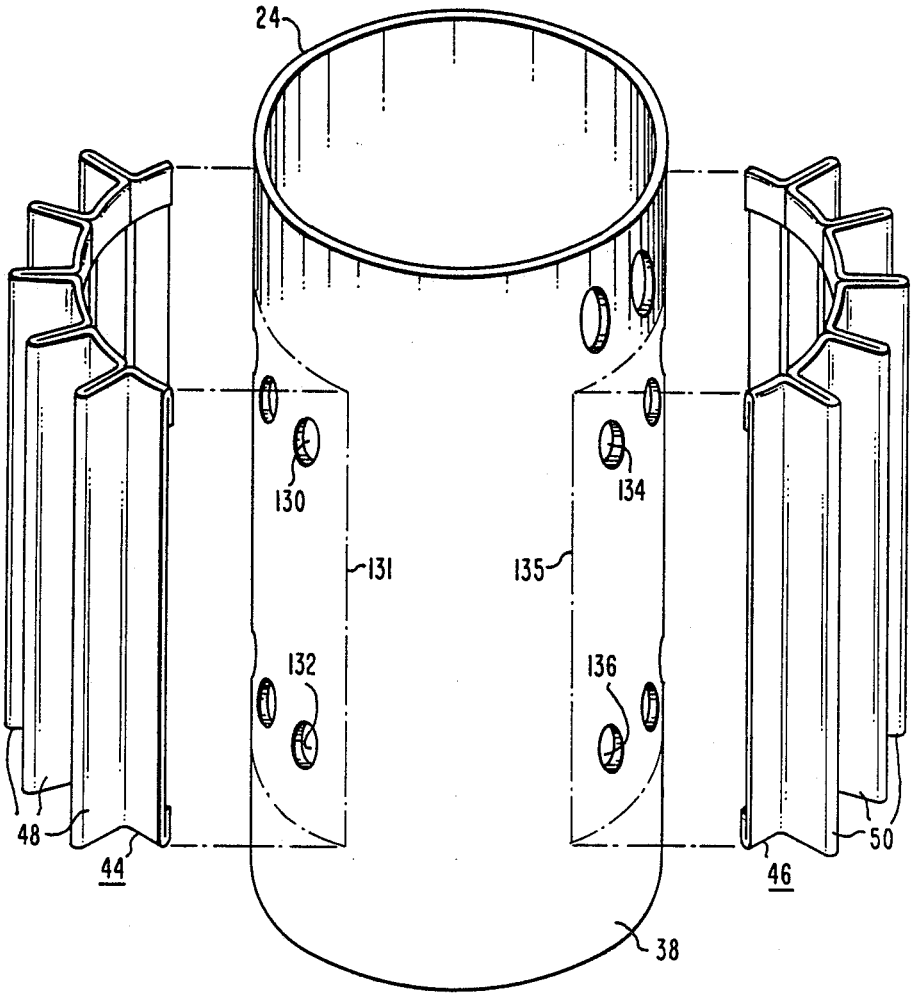
FIG. 16 is an exploded perspective view of the transformer shown in FIG. 1, illustrating an exemplary preparation of the transformer tank for receiving heat exchanger panels constructed according to the teachings of the invention.
Figure 17:
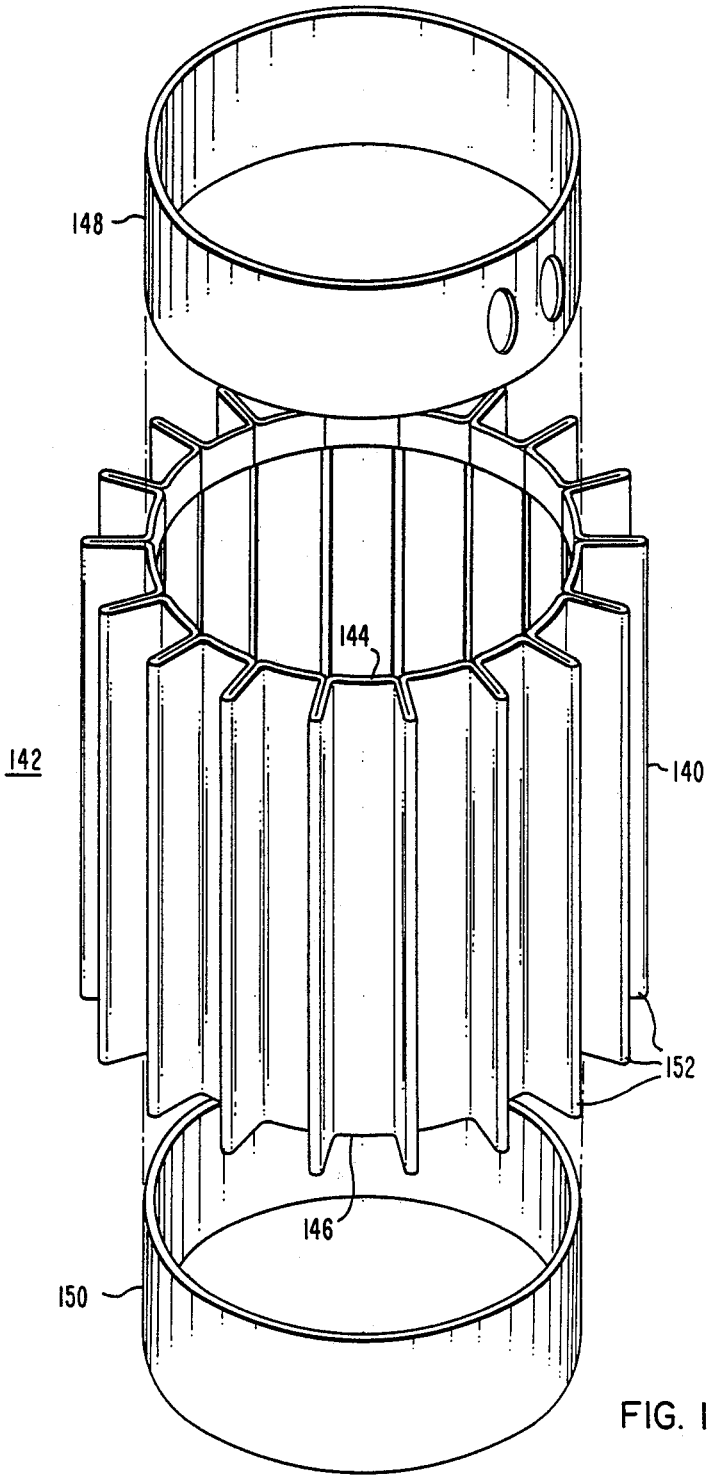
FIG. 17 is an exploded perspective view of a transformer tank/heat exchanger arrangement constructed according to another embodiment of the invention.
Figure 18:
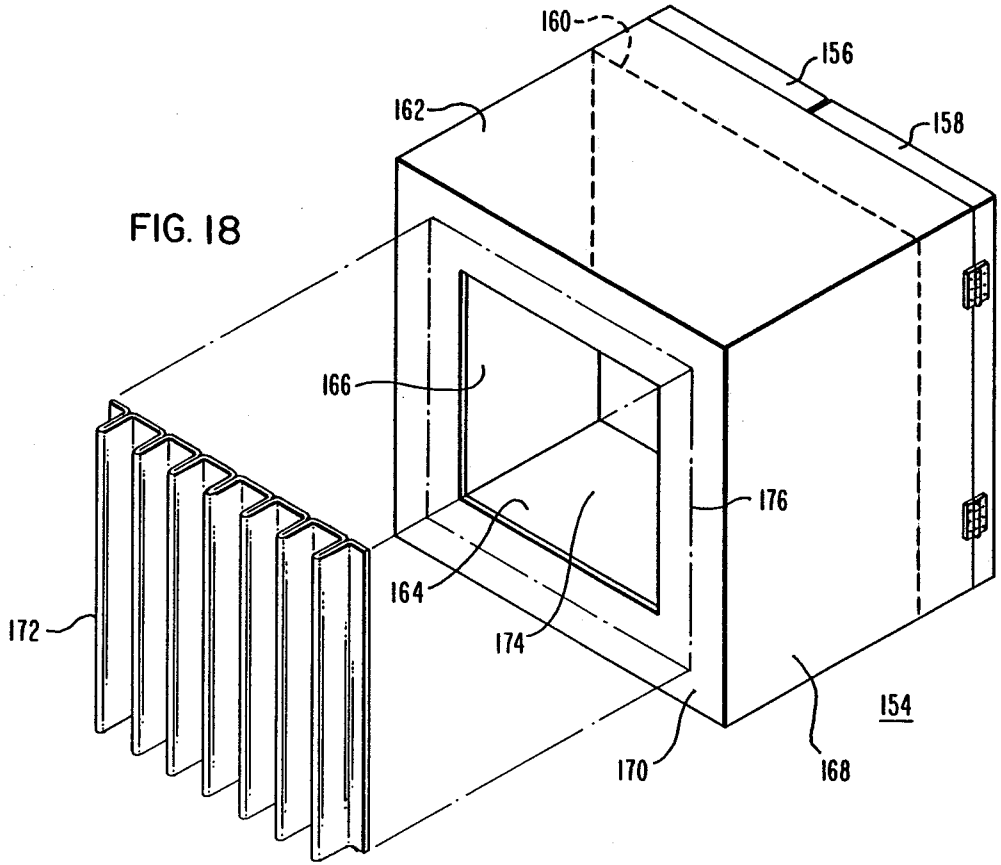
FIG. 18 is an exploded perspective view illustrating the invention applied to tanks having flat wall portions.

FIGS. 16, 17 and 18 are exemplary embodiments of uses of coolers constructed according to the teachings of the invention, illustrating that the coolers may be fastened to curved or flat side walls of tanks, either over the existing side wall which has openings located in registry with the fin cavities, or functioning as part of the side wall itself. FIG. 16 is an exploded perspective view which illustrates the tank 24 and heat exchanger panels 44 and 46 shown in FIG. 1 constructed according to an embodiment in which upper and lower openings 130 and 132 are provided in side wall 38 for each fin 48, and upper and lower openings 134 and 136 are provided in side wall 38 for each fin 50. Heat exchanger panel 44 is welded to tank wall 38 where indicated by broken line 131, and heat exchanger panel 46 is welded to tank wall 38 where indicated by broken line 135. The heated coolant 26 enters the upper openings 130 and 134, it proceeds downwardly through the fins 48 and 50, exchanging the heat in the fluid to the atmosphere from the large surface areas of the fins, and re-enters tank 24 via the lower openings 132 and 136.

FIG. 17 is an exploded perspective view of a tank and heat exchanger arrangement in which the heat exchanger forms part of the tank wall. More specifically, a cylindrical heat exchanger panel 140 functions as the intermediate portion of a cylindrical tank 142, with heat exchanger panel 140 having upper and lower edges 144 and 146, respectively, which are welded to upper and lower tank portions 148 and 150, respectively. While FIG. 17 illustrates an embodiment which requires enough cooling fins 152 to completely encircle tank 142, a heat exchanger panel with fewer fins may be used to displace the normal sidewall over any associated portion thereof. Instead of tank 142 being in separate pieces, the tank would then be a cylindrical one-piece structure with a rectangularly shaped cut-out sized to receive the heat exchanger panel.

FIG. 18 is a perspective view of a pad-mounted transformer tank 154 which has doors 156 and 158 which function as terminal covers to block access by unauthorized personnel to the front 154 of the tank 160, which front includes line terminals or bushings. Tank 154 includes flat wall portions, including top and bottom portions 162 and 164, side wall portions 166 and 168, and a back portion 170. One or more of the side or back wall portions are arranged to accept a heat exchanger panel, as required by the specific rating and design of the transformer. For example, the back portion 170 may be arranged to receive a flat heat exchanger panel 172. Back portion 170 may be provided with a series of upper and lower openings as shown in the embodiment of FIG. 16, or it may have a large opening 174 as shown in FIG. 18 to cause the heat exchanger panel to function as part of the back wall 170. Heat exchanger panel 172 is welded to the back wall 170 where indicated by the broken line 176.

Figure 19:
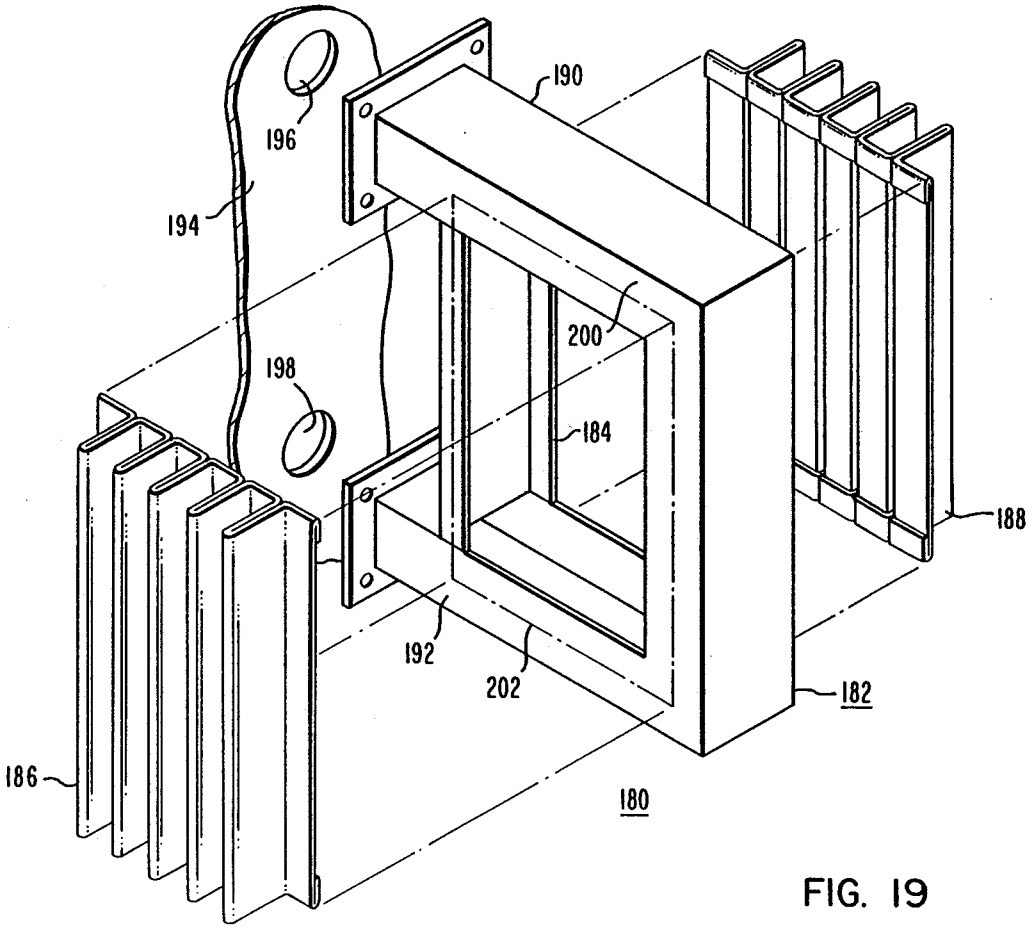
FIG. 19 is an exploded perspective view of an embodiment of the invention in which a separate heat exchanger or radiator is constructed having headers adapted for connection to the wall of apparatus to be cooled.

While the new and improved heat exchanger panels have been described to this point as being attached directly to the wall, or forming part of the wall, of electrical apparatus, it is to be understood that the invention is equally applicable to the construction of a separate heat exchanger or radiator which has headers adapted for connection to the wall of apparatus to be cooled. FIG. 19 is an exploded perspective view setting forth such an embodiment of the invention.

More specifically, FIG. 19 illustrates a heat exchanger 180 having a U-shaped frame 182, a filler strip 184, and heat exchanger panels 186 and 188. The U-shaped frame 182 and filler strip 184 cooperatively form upper and lower headers 190 and 192 which are adapted for connection to a tank wall 194 having openings 196 and 198 which respectively communicate with headers 190 and 192. The sides of the U-shaped frame 182 which lie in perpendicularly oriented planes form flat surfaces against which the peripheral edges of the heat exchanger panels 186 and 188 are welded, such as flat surface 200 for receiving heat exchanger panel 186, as indicated by broken line 202. The heat exchanger panels 186 and 188 are constructed according to the teachings of the invention, as hereinbefore set forth in detail.

In summary there has been disclosed new and improved electrical apparatus of the type which requires the addition of finned heat exchanger panels for proper exchange of internally generated heat to the atmosphere, and methods of constructing same. The new and improved methods and apparatus enable thinner steel sheet material to be used for constructing the heat exchanger panels, while at the same time increasing the ability of the heat exchanger panels to withstand the internal tank pressures associated with the electrical apparatus. The improvements are achieved by rolling predetermined edges of the starting sheet material, before the fins are fold-formed in a direction which directs the bond lines between the folded edges. In addition to increasing the mechanical strength of the resulting heat exchanger panel, the folded edges enable higher welding speeds to be used without increasing the risk of burn-through. The folded edges automatically provide a smooth straight edge, eliminating the need for any edge trimming, they are easier for manufacturing personnel to handle, and they improve paint adhesion and corrosion withstand capability.

I claim as my invention:

1. Electrical apparatus comprising:

a tank having a tank wall, fluid dielectric means in said tank, heat producing means in the tank, surrounded by said fluid dielectric means, and heat exchanger means, said heat exchanger means having peripheral edges connected to the tank wall, and a plurality of fins which extend in spaced parallel relation between predetermined peripheral edges, the spaced fins of said heat exchanger means each defining a cavity which is in fluid flow communication with said fluid dielectric means, said heat exchanger means including a metallic sheet member having a predetermined thickness dimension, said metallic sheet member having a plurality of folds, including edge folds which increase the thickness dimension along predetermined peripheral edges of said heat exchanger means beyond said predetermined thickness dimension, and spaced transverse folds arranged to provide:

(a) edge fold portions between the spaced fins which function as part of the peripheral edges of said heat exchanger means which are connected to said tank, and (b) edge fold portions in each fin which are adjacent to other edge fold portions, which adjacent edge fold portions are joined together, whereby the connection between the heat exchanger means and the tank wall is strengthened without adding significantly to the weight of the heat exchanger means.

2. The electrical apparatus of claim 1 wherein the tank wall to which the heat exchanger means is connected is a cylindrical surface.

3. The electrical apparatus of claim 1 wherein the tank wall includes a cylindrical surface, with the heat exchanger means functioning as part of the tank wall which includes the cylindrical surface.

4. The electrical apparatus of claim 3 wherein the heat exchanger means extends completely around the tank.

5. The electrical apparatus of claim 1 wherein the tank wall includes a cylindrical surface, with the heat exchanger means being connected to said cylindrical surface, and including openings in said cylindrical surface which are in fluid flow communication with the fins of the heat exchanger means.

6. The electrical apparatus of claim 1 wherein the tank wall to which the heat exchanger means is connected is a flat surface.

7. The electrical apparatus of claim 1 wherein the tank wall includes a flat surface, with the heat exchanger means functioning as part of the tank wall which includes the flat surface.

8. The electrical apparatus of claim 1 wherein the tank wall includes a flat surface, with the heat exchanger means being connected to said flat surface, and including openings in said flat surface which are in fluid flow communication with the fins of the heat exchanger means.

9. The electrical apparatus of claim 1 wherein the edge folds are a single fold, effectively doubling the predetermined thickness dimension in the area of the edge folds.

10. The electrical apparatus of claim 1 wherein the edge folds are a double fold, effectively tripling the predetermined thickness dimension in the area of the edge folds.

11. A method of constructing a heat exchanger suitable for fluid filled electrical apparatus, comprising the steps of:

providing a flat metallic sheet having a plurality of edges which define a substantially rectangular configuration, folding the metallic sheet adjacent to predetermined edges thereof which are located on opposite sides of said rectangular configuration, to increase the thickness dimension of the metallic sheet along the resulting folded edges, bending the flat metallic sheet along a bend line which extends from folded edge to folded edge, while maintaining a predetermined spacing between the sheet material in the area of the fold, to form a fin having adjacent folded edges on opposite sides thereof, welding the adjacent folded edges of the fin to one another, on each side of the fin, to provide a heat exchanger panel having a fin which defines a cavity having an opening at one end thereof, providing a tank having a tank wall, and connecting the heat exchanger panel to the tank wall such that the cavity defined by the fin is in fluid flow communication with the inside of said tank.

12. The method of claim 11 wherein the step of folding the metallic sheet adjacent to the predetermined edges includes forming a single bend line, to effectively double the thickness of the resulting folded edge.

13. The method of claim 11 wherein the step of folding the metallic sheet adjacent to the predetermined edges includes successively forming first and second bend lines to effectively triple the thickness of the resulting folded edge.

14. The method of claim 13 wherein the directions of folding the metallic sheet from the first and second bend lines are opposite to one another.

15. The method of claim 13 wherein the directions of folding the metallic sheet from the first and second bend lines are the same.

16. The method of claim 11 wherein the steps of bending and welding are repeated a predetermined number of times to provide a heat exchanger panel having a plurality of fins.

17. The method of claim 11 wherein the step of providing a tank having a tank wall includes the step of providing an opening in the tank wall which is only slightly smaller than the heat exchanger panel, such that the heat exchanger panel functions as a part of the tank wall.

18. The method of claim 16 wherein the heat exchanger panel has a circular configuration, and the step of providing a tank having a tank wall provides upper and lower tank sections each having a circular configuration, with the step of connecting the heat exchanger panel to the tank including the step of welding the heat exchanger panel to both the upper and lower tank sections, such that the heat exchanger panel functions as the tank wall between the two tank sections.

19. The method of claim 11 wherein the step of providing a tank having a tank wall includes the step of providing two spaced openings in the tank wall which are in fluid flow communication with the fin.

20. The method of claim 16 wherein the step of providing a tank having a tank wall includes the step of providing two spaced openings in the tank wall for each of the fins in the heat exchanger panel.

21. A heat exchanger, comprising:

a metallic sheet member having a predetermined thickness dimension, peripheral edges adapted for connection to a metallic structure, and a plurality of fins which extend in spaced relation between predetermined peripheral edges, said metallic sheet member having a plurality of folds, including edge folds which increase the thickness dimension along predetermined peripheral edges of said heat exchanger beyond said predetermined thickness dimension, and spaced transverse folds arranged to provide:

(a) edge fold portions between the spaced fins which function as part of the peripheral edges of said heat exchanger means which are connected to said tank, and (b) edge fold portions in each fin which are adjacent to other edge fold portions, which adjacent edge fold portions are joined together, whereby a connection between the heat exchanger and metallic structure is strengthened without adding significantly to the weight of the heat exchanger.

22. The heat exchanger of claim 21 wherein the edge folds are a single fold, effectively doubling the predetermined thickness dimension in the area of the edge folds.

23. The heat exchanger of claim 21 wherein the edge folds are a double fold, effectively tripling the predetermined thickness dimension in the area of the edge folds.

24. A method of constructing a heat exchanger panel, comprising the steps of:

providing a flat metallic sheet having a plurality of edges which define a substantially rectangular configuration, folding the metallic sheet adjacent to predetermined edges thereof which are located on opposite sides of said rectangular configuration, to increase the thickness dimension of the metallic sheet along the resulting folded edges, bending the flat metallic sheet along a bend line which extends from folded edge to folded edge, while maintaining a predetermined spacing between the sheet material in the area of the fold, to form a fin having adjacent folded edges on opposite sides thereof, and welding the adjacent folded edges of the fin to one another, on each side of the fin, to provide a heat exchanger panel having a fin which defines a cavity having an opening at one end thereof.

25. The method of claim 24 wherein the step of folding the metallic sheet adjacent to the predetermined edges includes forming a single bend line, to effectively double the thickness of the resulting folded edge.

26. The method of claim 24 wherein the step of folding the metallic sheet adjacent to the predetermined edges includes successively forming first and second bend lines to effectively triple the thickness of the resulting folded edge.

27. The method of claim 26 wherein the directions of folding the metallic sheet from the first and second bend lines are opposite to one another.

28. The method of claim 26 wherein the directions of folding the metallic sheet from the first and second bend lines are the same.

29. The method of claim 24 wherein the steps of bending and welding are repeated a predetermined number of times to provide a heat exchanger panel having a plurality of fins.

* * * * *